US006758365B2

(12) United States Patent
Jackson

(10) Patent No.: US 6,758,365 B2
(45) Date of Patent: Jul. 6, 2004

(54) CONTAINER WITH HANDLE REGION TO RECEIVE A ROPE HANDLE

(75) Inventor: Steven Jackson, Woodbridge (CA)

(73) Assignee: Royal Alliance Inc., Woodbridge (CA)

( * ) Notice: Subject to any disclaimer, the term of this patent is extended or adjusted under 35 U.S.C. 154(b) by 140 days.

(21) Appl. No.: 10/216,983

(22) Filed: Aug. 13, 2002

(65) Prior Publication Data

US 2004/0031806 A1 Feb. 19, 2004

(51) Int. Cl.[7] ..... B65D 25/10
(52) U.S. Cl. ..... 220/754
(58) Field of Search ..... 220/754

(56) References Cited

U.S. PATENT DOCUMENTS 3,734,336 A * 5/1973 Rankow et al. ..... 220/516
3,848,760 A * 11/1974 Rausing ..... 215/12.1
4,068,779 A * 1/1978 Canfield ..... 220/754
6,283,346 B1 * 9/2001 Thomas ..... 224/148.6

* cited by examiner

*Primary Examiner*—Joseph Man-Fu Moy

(57) ABSTRACT

A container has a handle region specifically designed to receive a rope handle. The handle region is provided with a rope fitting opening which leads to a flexible rope grip member. The rope grip member flexes open to a rope insertion and release position in a direction away from the opening and pinches inwardly to a rope grip position in a direction at the opening in the handle region of the container.

8 Claims, 3 Drawing Sheets

CONTAINER WITH HANDLE REGION TO RECEIVE A ROPE HANDLE

FIELD OF THE INVENTION

The present invention relates a container with a handle region specifically designed to receive a rope handle.

BACKGROUND OF THE INVENTION

Rope handles are used on numerous different types of containers. One of these different types of containers is in the form of an open top bucket having a peripheral upper lip with rope handles fitted through the upper lip to opposite sides of the bucket.

The typical method of fitting a rope handle to a container e.g., a bucket type container, is to fit each end of the rope through an opening in the container wall and to then somehow expand the opposite ends of the rope so that they cannot pull back through the opening. The expansion of the ends of the rope can be done in many different ways as for example, by knotting the ends of the rope or by attaching something to the rope.

Some rope handles have a nylon or similar plastic material construction and the ends of this type of rope can be enlarged by melting the rope end.

All of the above rope treatment processes are labor intensive which can add significantly to the cost of a container which might otherwise be relatively inexpensive. Furthermore, when working with a nylon type rope the melting of the rope ends makes the attachment of the rope to the container permanent. The rope can only be released from the container by cutting off the rope ends. Furthermore, these rope ends can be difficult to cut off because of both the use of nylon material in making the handle and the thickness of the nylon.

SUMMARY OF THE PRESENT INVENTION

The present invention relates to a container having a handle region to receive a rope handle in a manner which avoids the drawbacks of prior art container handles. More specifically, the handle region on the container of the present invention is provided with a rope fitting opening through the handle region. The handle region also includes a flexible rope grip which flexes open to a rope insertion and release position in a direction away from the opening. The rope grip member then pinches inwardly to a rope grip position in a direction at the opening in the handle region of the container.

When working with a container having a handle region according to the present invention the end of the rope is first passed through the opening. It is then fitted in the rope grip which flexes open to receive the rope end. However, when the container is lifted by the handle, the rope end is pulled in a direction back towards the opening in the handle region causing the rope grip to pinch on the rope end trapping the rope handle with the container.

In the event that the handle becomes damaged or if it is desired to replace the handle for any other reason the end of the rope can simply be released from the rope grip. It is then pulled back through the opening in the handle region to allow the fitting of a new rope handle with the container.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 1:
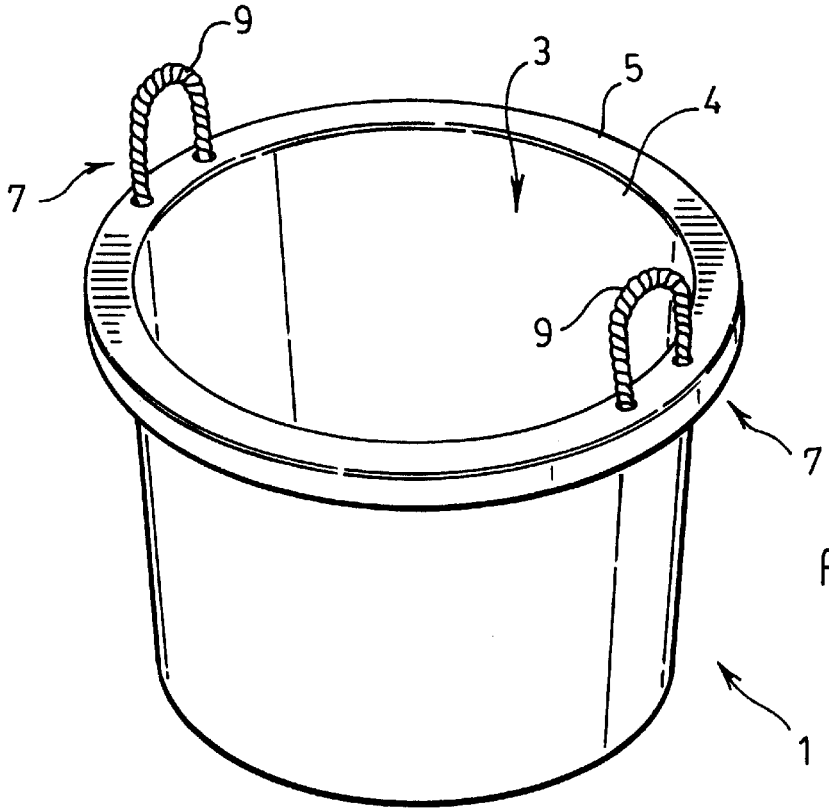
FIG. 1 is top perspective view of a bucket type container fitted with a pair of rope handles according to a preferred embodiment of the present invention.

FIG. 1 shows a container generally indicated at 1. In this particular example, the container is in the form of a bucket having a contents receiving region generally indicated at 3. This region is surrounded by an upper edge part 5 extending laterally of the bucket. This lateral edge part is provided with a pair of handle receiving regions generally indicated at 7. Each of these handle regions receives a rope handle 9.

Figure 2:
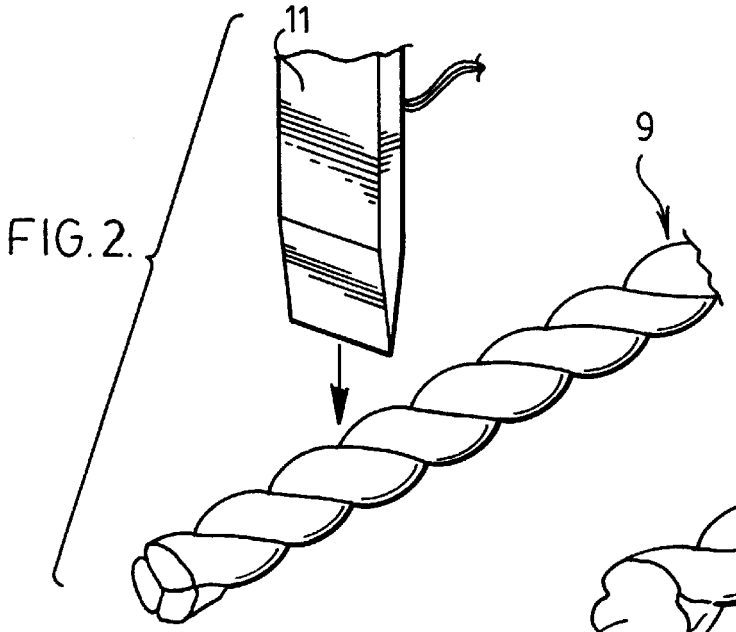
FIGS. 2 and 3 are perspective views showing the treatment of the end of one of the rope handles from the bucket of FIG. 1 according to a preferred embodiment of the present invention.
Figure 3:
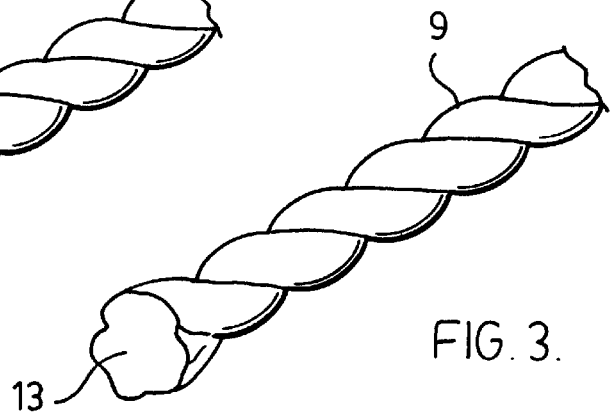

According to a preferred embodiment of the present invention, the rope handles have a plastic e.g. nylon construction and the rope ends are formed as shown in FIG. 2 of the drawings. More specifically, a heated cutting tool 11 penetrates through the rope to form a rope end 13 shown in FIG. 3. This rope end is fused as it is cut by the tool to prevent fraying of the nylon. The fusing produces a hardening and slight enlargement of the rope end 13 relative to the main body of the rope.

Figure 4:
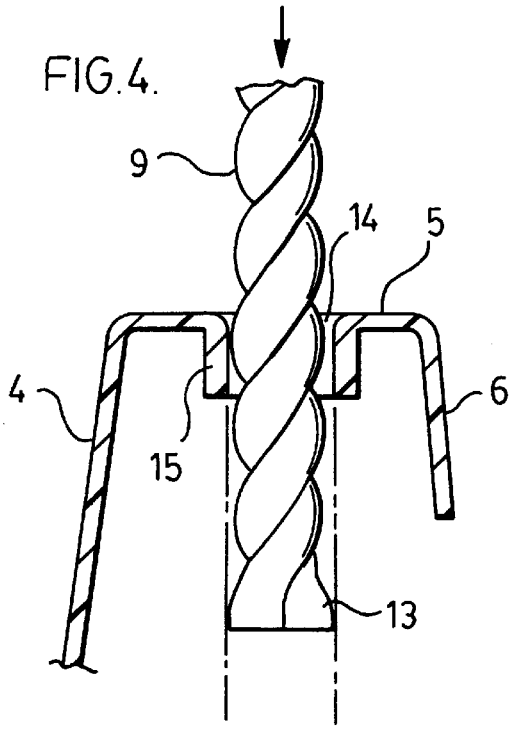
FIGS. 4 and 5 are sectional views through an upper edge region of the bucket of FIG. 1 where one end of one of the handles fits through the edge region of the bucket.
Figure 5:
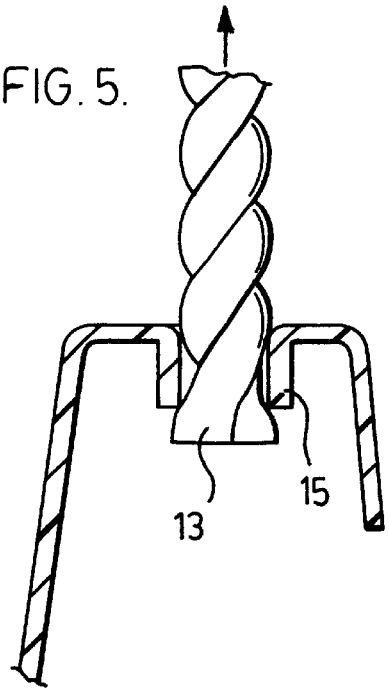

Reference is now had to FIGS. 4 through 8 of the drawings. These figures and in particular FIGS. 4 and 5 show that the upper edge part 5 of the container is bordered to the inside by the interior wall 4 of the bucket and by an exterior lip 7. The handle region of the bucket is located between wall 4 and lip 7.

It should be noted that the bucket itself is made from a relatively rigid plastic material shaped through a molding process. Therefore, all of the bucket parts including the components of the handle region constitute an integral part of the bucket.

One of the handle components comprises an elongated eyelet 15 formed downwardly from the upper edge 5 of the bucket. This eyelet defines a generally circular hole 14 through the bucket edge. The eyelet 15 tapers slightly inwardly from the upper to the lower part of the eyelet so that the rope end fitting opening 14 is of slightly smaller diameter at the bottom than it is at the top of the eyelet.

FIG. 4 shows that the fused end 13 of the rope handle 9 is forced downwardly from the top of the bucket through eyelet 15. The rope end is slightly undersized relative to the opening 14 in the upper region of the eyelet and as such will easily fit into the eyelet. However, the rope end must be forced through the bottom end of the eyelet to produce a slight collapsing of the rope end to fit it completely through the eyelet. The resilient nature of the rope material causes it to rebound back to its normal diameter which is slightly enlarged relative to the lower edge of the eyelet as shown in FIG. 5 of the drawings. These relative proportions as well as the hardened nature of the rope end produced during the rope fusing provides a resistance to removal of the rope end from the opening in the bucket edge. The resistance, although sufficient to support some load in the bucket, is not so great at to preclude pulling of the rope end out of the bucket edge for handle replacement purposes or the like. This does not cause any damage to the handle and therefore this same rope handle can be re-used in a further handle application.

The lock between the rope end and the eyelet is not the main rope end lock of the handle region. The heavier duty locking of the rope end is provided by means of a rope grip best shown in FIGS. 6 and 7 of the drawings.

More specifically, the rope grip comprises a pair of plastic flaps 21 provided on the back surface of a rigid wall part 17 of the bucket edge. The front face of this wall part faces the eyelet 15. Provided in wall part 17 is an open ended slot 19 which extends parallel to and is located to one side of the eyelet.

Figure 8:
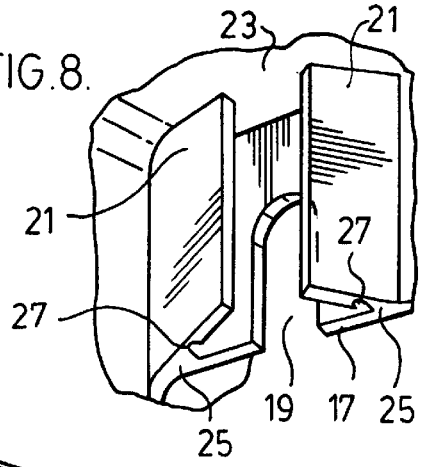
FIG. 8 is an enlarged perspective view of a rope guide and rope pinch assembly from the handle region of FIG. 6.
Figure 9:
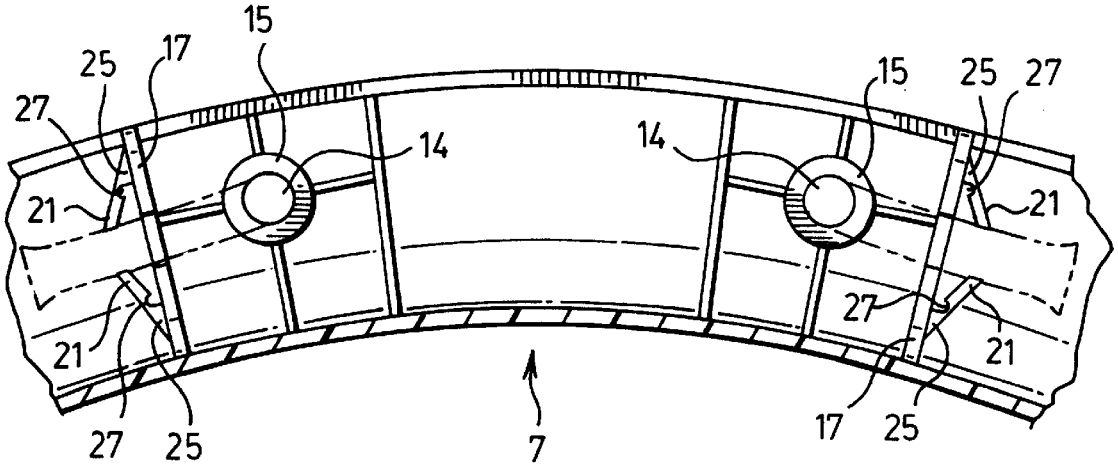
FIG. 9 is a bottom view of the entirety of one of the two handle regions from the bucket of FIG. 1.

As best shown in FIG. 8 of the drawings the flaps 21 each have a wide base 25 where they are formed with wall part 17. Provided in each of the flaps is a notch 27 which is on the side of each flap facing wall part 17.

Figure 6:
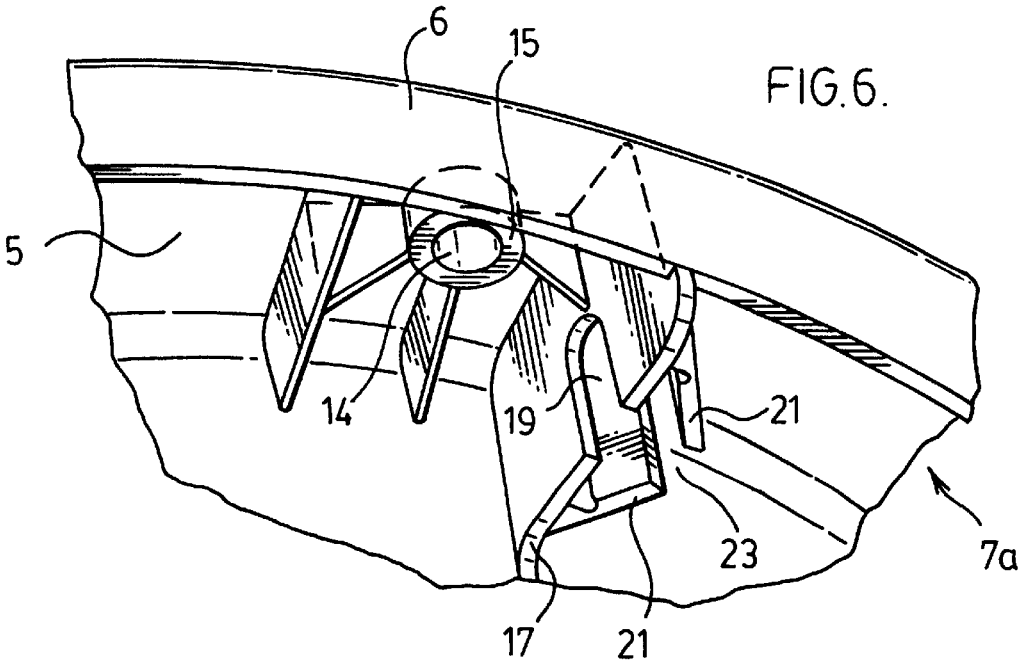
FIG. 6 is a bottom perspective view of one side of one of the handle regions of the bucket of FIG. 1.

The two flaps, which as shown in FIG. 6 are molded in an angle inclined from wall part 17, are separated at their free ends by a gap 23. This gap aligns with the slot 19 in wall part 17.

FIG. 8 of the drawings shows how the rope end is secured within the flexible rope grip. In particular, the rope end after being passed through eyelet 15 is pulled to produce enough length of the rope beneath the edge part of the bucket such that the rope can be slid upwardly into the gap 23 between the flaps 21 and also into the slot 19 of the rope guiding wall part 17.

When the flaps 21 are in their normally set position as shown in FIG. 8 the gap 23 between the ends of the flaps is slightly undersized relative to the diameter of the rope. The sliding of the rope between the flaps causes them to separate sufficiently far to receive and clamp onto the rope. Therefore when the rope is inserted between the flaps it will not simply pull out of the rope grip.

The flaps 21 are somewhat flexible particularly in the area of the notches 27 which allows them to flex open in a direction away from the rigid wall part 17. This increases the width of the gap 23 allowing both insertion and release of the rope from the flexible rope grip.

Figure 7:
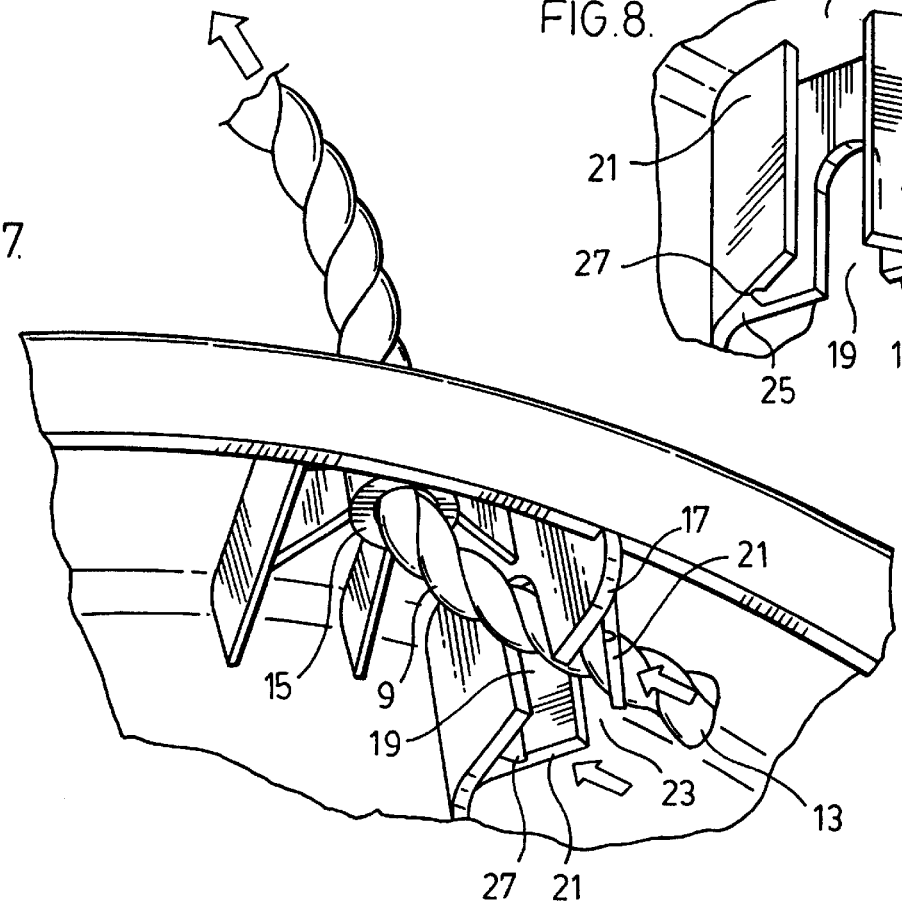
FIG. 7 is a view similar to FIG. 6 when the handle region is fitted with the end of the rope.

Once the rope is fitted into the FIG. 7 position the two flaps 21 frictionally engage the rope to prevent the rope from being pulled, when under load, out of the rope grip. In fact, the more load applied on the rope the more there is a tendency to pull the flaps in a direction towards wall part 17. This further decreases the gap between the two flaps 21 applying even greater rope holding pressure by the pinching action of the flaps on the rope.

It should be noted that the placement of the wall part 17 to one side of the eyelet 15 requires that the rope be turned at nearly a 90 degree angle after passing through the eyelet to be fitted into the rope grip. This adds to the locking action because the pull along the main body of the handle above the bucket is not directly aligned with the rope grip towards the end of the rope handle.

It will be seen from the description above how a rope handle, with only slight modifications to the end of the rope, can easily be fitted into and if desired easily removed from an extremely effective flexible rope grip of a bucket or any other type of container using a rope handle.

Although various preferred embodiments of the present invention have been described in detail, it will be appreciated by those skilled in the art that variations may be made without departing from the spirit of the invention or the scope of the appended claims.

What is claimed is:

1. A container having a handle region to receive a rope handle, the handle region being provided with a rope fitting opening through the handle region and a flexible rope grip member which flexes open to a rope insertion and release position in a direction away from the opening and which pinches inwardly to a rope grip position in a direction toward the opening in the handle region of the container.

2. A container as claimed in claim 1 wherein the rope fitting opening comprises a rigid elongated eyelet which tapers inwardly towards said rope grip member.

3. A container as claimed in claim 1 wherein the rope fitting opening comprises a rigid elongated eyelet and said rope grip member is provided on a back face of a rigid rope guide where the rope guide has a front face towards said eyelet.

4. A container as claimed in claim 3 wherein said rope guide comprises a rigid wall part of the edge region, the wall part being provided with an open ended slot, the rope grip member comprising a pair of moveable flaps supported on the back face of the rope guide, the flaps being separated by a gap, the gap between the flaps aligning with the slot in the wall part and increasing in gap width as the flaps flex open away from the wall part and decreasing in gap width as the flaps flex inwardly at the wall part.

5. A container as claimed in claim 4 wherein said handle region is provided on a lateral edge part of the container.

6. A container as claimed in claim 5 wherein said slot of said wall part extends parallel to and is located to one side of said eyelet.

7. A container as claimed in claim 4 wherein said handle region is an integral part of said container and said container has a rigid plastic construction, said flaps being molded on the back face of the rope guide.

8. A container as claimed in claim 7 wherein each of said flaps has a wide base at the rigid wall part, a main flap body which terminates at the gap between the flaps and a notch in the flap body facing the rigid wall part.

* * * * *